US007731601B2

(12) United States Patent
Penton

(10) Patent No.: US 7,731,601 B2
(45) Date of Patent: Jun. 8, 2010

(54) PITCH-MARK REPAIR TOOL FOR A GOLF CLUB

(76) Inventor: Hugh V. Penton, 45 Saint Malo Beach, Oceanside, CA (US) 92054

( * ) Notice: Subject to any disclaimer, the term of this patent is extended or adjusted under 35 U.S.C. 154(b) by 113 days.

(21) Appl. No.: 11/225,497

(22) Filed: Sep. 14, 2005

(65) Prior Publication Data

US 2007/0060412 A1 Mar. 15, 2007

(51) Int. Cl.
*A63B 57/00* (2006.01)

(52) U.S. Cl. ..... 473/286; 172/378

(58) Field of Classification Search ..... 473/286; 172/378

See application file for complete search history.

(56) References Cited

U.S. PATENT DOCUMENTS

| | | | | |
|---|---|---|---|---|
| 4,955,609 | A | 9/1990 | Kassen | |
| 5,163,685 | A * | 11/1992 | Rhodes | 473/206 |
| 5,277,425 | A * | 1/1994 | Petriano, Sr. | 473/286 |
| 5,351,949 | A * | 10/1994 | Fox et al. | 473/285 |
| 5,437,449 | A | 8/1995 | Zink | |
| 5,779,558 | A * | 7/1998 | Britton | 473/286 |
| 6,244,356 | B1 | 6/2001 | Luna | |
| 6,585,606 | B2 * | 7/2003 | Penrose | 473/284 |
| 6,692,374 | B1 * | 2/2004 | Colbo | 473/286 |
| 6,811,495 | B2 * | 11/2004 | Penrose | 473/284 |
| 6,899,635 | B2 * | 5/2005 | Nadratowski et al. | 473/285 |
| 2003/0083142 | A1 * | 5/2003 | Nam | 473/286 |
| 2006/0150459 | A1 * | 7/2006 | Wang | 40/663 |

* cited by examiner

*Primary Examiner*—Stephen L. Blau
(74) *Attorney, Agent, or Firm*—Morland C. Fischer

(57) ABSTRACT

A pitch-mark repair tool to be carried by a golf club (e.g., a putter) to enable a golfer to quickly and easily repair an impact area at a putting green of a golf course caused by the impact of a golf ball striking the green during play. The pitch-mark repair tool includes a base to be affixed to the grip which surrounds one end of the golf club shaft. A plurality of upstanding earth leveling prongs project from the base for use in lifting up the earth to a level, smooth surface over the impact area to be repaired. A fastener having a set of helically wound screw threads extends through the base and the grip for receipt in the existing vent hole of the grip for holding the base against the grip. An end cap is detachably connected in surrounding engagement with the base to enclose the upstanding prongs therewithin and thereby prevent injury to the golfer. A recess is formed in the end cap within which a standard golf ball marking disk is seated so as to be readily available to the golfer for marking the position of his golf ball on a putting green.

11 Claims, 3 Drawing Sheets

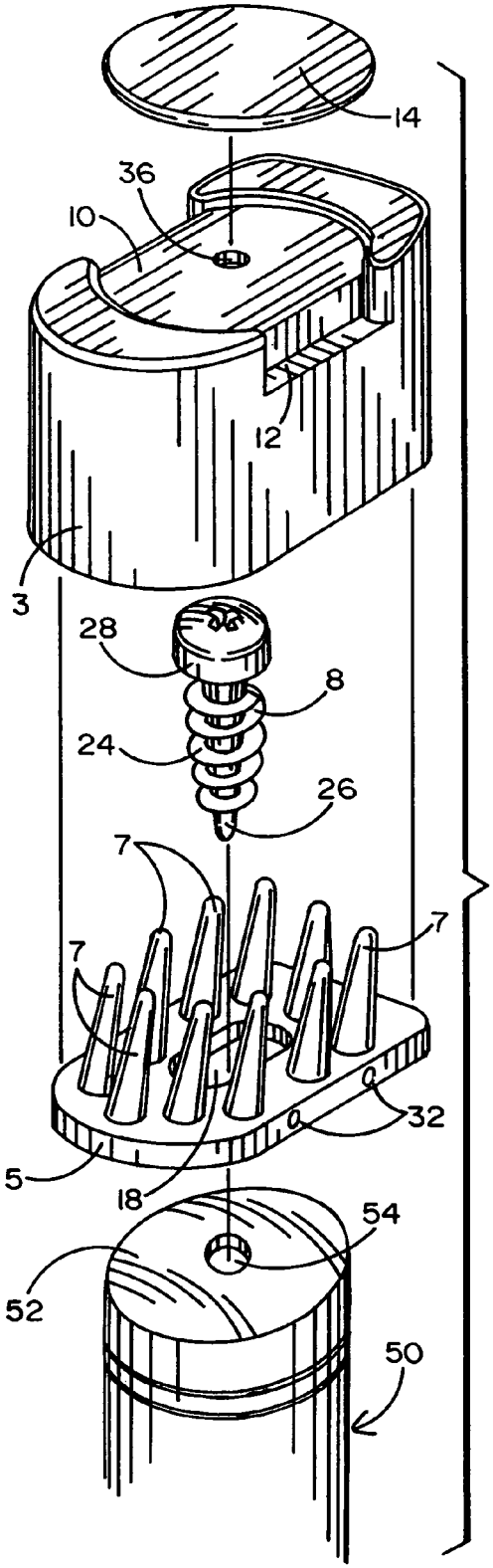
FIG. 4
FIG. 5
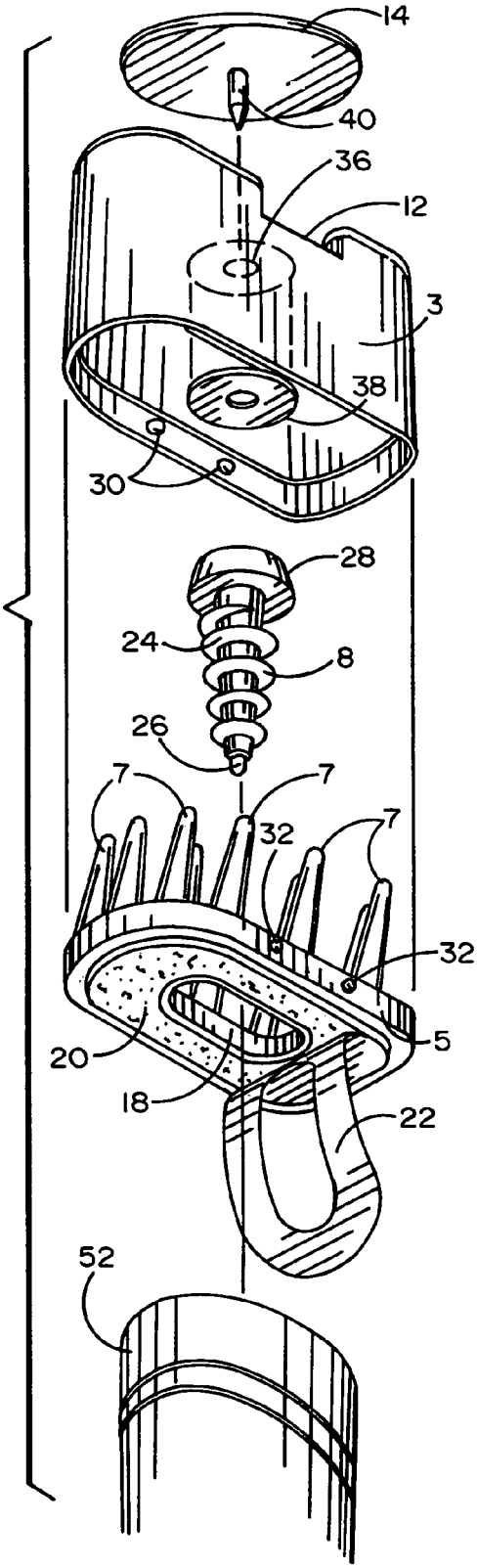

PITCH-MARK REPAIR TOOL FOR A GOLF CLUB

BACKGROUND OF THE INVENTION

1. Field of the Invention

This invention relates to a pitch-mark repair tool to be attached to and carried by a golf club (e.g., a putter) and having a set of earth leveling prongs by which to enable a golfer to easily repair damaged areas of a putting green that are left by a ball striking the putting green during the game of golf. The prongs are surrounded by a detachable cover which includes a recess within which a standard golf ball marking disk is seated so as to be readily available for use by the golfer in marking the position of his golf ball on the green.

2. Background Art

It is common during the game of golf for a golf ball to impact a putting green on a golf course and leave a depression or a pitch-mark in the grass surface of the green. According to the rules of golf, the golfer is required to repair the grass surface of the green if his or her ball created the pitch mark.

One approach for successfully repairing the putting green in which a pitch-mark is made uses a tee or a "divot tool" to pry up the grass sod from the green in an effort to even out the surface. This requires the golfer to kneel down or bend over to attempt the repair. However, such divot tools are known to pull out the grass roots so that a bare or uneven spot is left on the surface of the green. In this same regard, golfers may not be inclined to kneel down and spend time necessary to repair the damaged area. Consequently, the pitch-marks are frequently not repaired which may leave a putting green covered with a variety of unsightly bare and/or brown spots that, in some instances, create an uneven putting surface that could adversely affect play.

An example of a repair tool by which to repair pitch-mark areas in a putting green caused by balls striking the green is described in U.S. Pat. No. 6,244,356 issued 12 Jun. 2001. This patented tool is attached to one end of the shaft of a putter. However, in order to install the patented tool, the hand grip which covers the shaft must first be cut open and the end of the shaft removed to accommodate a complex fastener system for holding the tool inside the shaft. Therefore, the grip and the shaft will be in need of repair should the patented tool be removed from the putter.

It would therefore be desirable to have available an easy to use pitch-mark repair tool to be attached to and carried by a golf club without having to alter or damage the original club.

SUMMARY OF THE INVENTION

In general terms, a pitch-mark repair tool is disclosed to be attached to the grip at one end of the shaft of a golf club (e.g., a putter) so as to be readily available to a golfer to repair pitch-mark areas that are left after a ball strikes a putting green of a golf course. The pitch-mark repair tool is attached to the grip without having to alter the golf club or damage the grip. A flat base has a plurality of earth leveling prongs projecting therefrom. A peel-off cover is removed from a layer of pressure sensitive adhesive that is carried by the base so that the base is adhesively bonded over the grip at the end of the shaft. A special-purpose fastener (e.g., a screw) is inserted through the base and the grip for receipt through the existing vent hole of the grip, whereby to securely attach the base to the grip over the shaft. The fastener has a pointed tip and a set of helically wound screw threads running continuously therealong. An end cap is detachably connected in surrounding engagement with the base to enclose the upstanding prongs and thereby prevent injury to the golfer. A recess is formed in the base so that a standard golf ball marking disk can be seated therein. Finger ledges are positioned alongside the recess in which to receive the golfer's fingertips for pulling the marking disk out of the recess and off the end cap to enable the golfer to mark the position of his golf ball on the putting green.

In order to repair a pitch-mark area of the green caused by a ball impact, the golfer first removes the end cap from the base to expose the earth leveling prongs projecting therefrom. Then, with a single hand and without kneeling down, the golfer grasps the shaft and turns the putter upside down. The prongs at the end of the shaft are pushed into the grass surrounding the bare area. A series of jabbing forces applied to the shaft are transferred to the prongs for lifting up the grass surrounding the pitch-marks and leveling out the damaged area until the area is smooth. Once the pitch-mark repair is completed, the end cap is returned to its detachable connection in surrounding engagement with the base so that the golf club can be used to tap down on the repair.

BRIEF DESCRIPTION OF THE DRAWINGS

FIG. 4 is an exploded top view to illustrate the attachment of the pitch-mark repair tool to the grip of the putter of FIG. 1;

FIG. 5 is an exploded bottom view to illustrate the attachment of the pitch-mark repair tool to the putter grip;

DESCRIPTION OF THE PREFERRED EMBODIMENT

Figure 1:
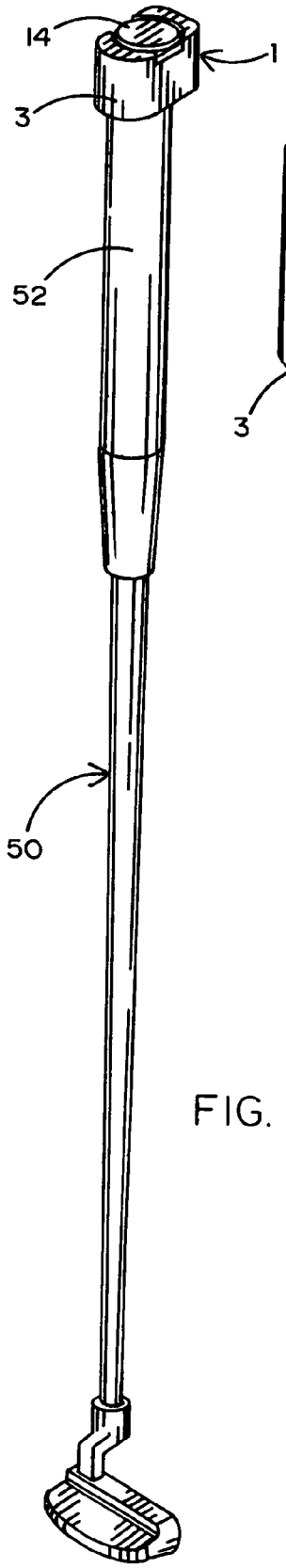
FIG. 1 shows a golf putter having a pitch-mark repair tool according to the preferred embodiment attached to the grip which covers one end of the putter shaft.
Figure 2:
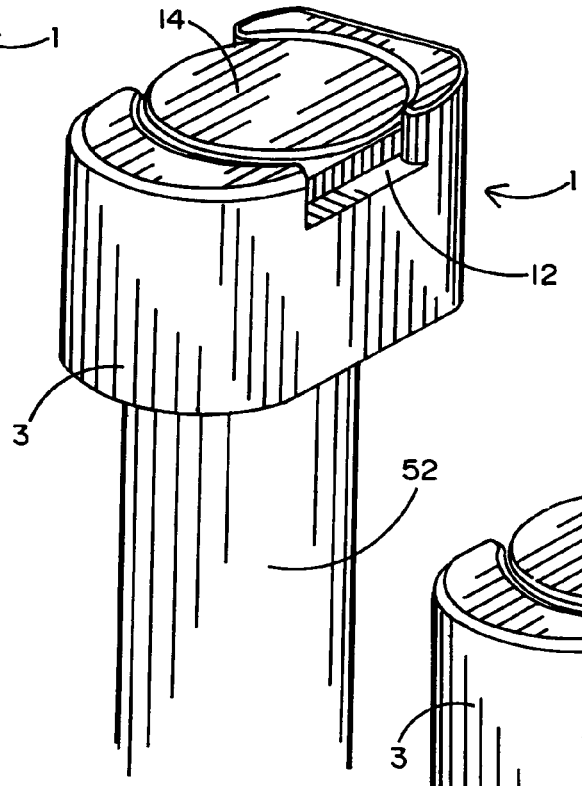
FIG. 2 shows an enlargement of the pitch-mark repair tool of FIG. 1.
Figure 3:
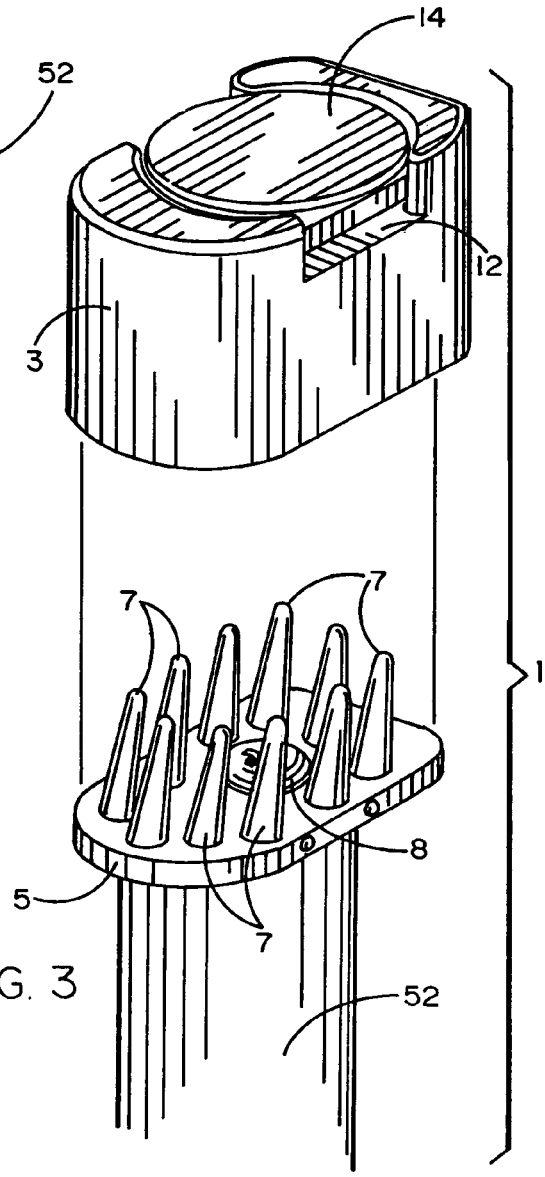
FIG. 3 shows a detachable end cap removed from a base of the pitch-mark repair tool to expose a plurality of earth leveling prongs.

A preferred embodiment for a pitch-mark repair tool 1 which forms the present invention is initially described while referring concurrently to FIGS. 1-3 of the drawings. Although the pitch-mark repair tool is shown carried at the end of a putter 50, it is to be understood that tool 1 can be attached to any other golf club by which to enable a golfer to quickly and easily repair pitch-mark areas of a putting green on a golf course that are caused by a golf ball striking the surface of a green while playing the game of golf.

The pitch-mark repair tool 1 includes an end cap 3 that is preferably manufactured from a molded plastic. The end cap 3 is detachably connected over a flat base 5 so as to surround a plurality of earth leveling prongs 7 that are integrally connected to and stand upwardly from the base 5. The prongs 7 are shown aligned parallel with one another and extending at a slight angle (e.g., 5 to 10 degrees) relative to the perpendicular axis of the base 5. As will be explained in greater detail hereinafter when referring to FIGS. 4 and 5, the base 5 is affixed to the rubber grip 52 of the putter 50 by means of a special-purpose screw threaded fastener 8.

Figure 7:
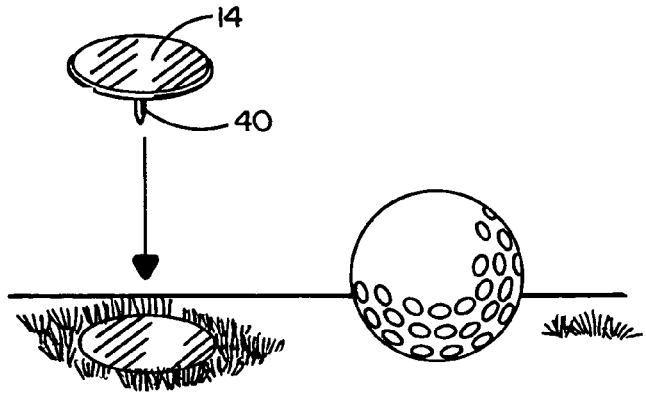
FIG. 7 shows a golf ball marking disk for marking the position of a golf ball on the putting green after the marking disk has first been removed from a recess in the base of the pitch-mark repair tool.

As will also be explained in greater detail, the end cap 3 has a recess (designated 10 in FIG. 4) molded into the top thereof. A pair of finger ledges 12 are also molded into opposite sides of the end cap 3 so as to lie below the recess 10. As an important advantage of the pitch-mark repair tool 1, the recess 10 in end cap 3 is sized and dimensioned so that a standard golf ball marking disk 14 can be removably received therewithin. By virtue of the finger ledges 12, a golfer will be able to use his fingertips to grasp the golf ball marking disk 14 when it is necessary to pull the disk 14 off the end cap 3 for use in marking the position of his golf ball on a putting green of a golf course (best shown in FIG. 7).

Details of the pitch-mark repair tool 1 are now disclosed while referring to FIGS. 4 and 5 of the drawings. As another important advantage of this invention, the pitch-mark repair tool 1 is attached to the putter 50 without having to alter the putter and without having to remove or destroy the grip 52. In this regard, the rubber grip 52 is commonly wrapped around one end of the shaft of most putters. A vent hole 54 is formed through the top of grip 52 to communicate with the hollow interior of the shaft of putter 50. The base 5 of pitch-mark repair tool 1 is fixedly attached to the shaft of putter 50 by way of the vent hole 54 through grip 52.

More particularly, a wide, slotted mounting hole 18 is formed through the base 5. With the base 5 of pitch-mark repair tool 1 laid upon the grip 52 at the end of the shaft of putter 50, the mounting and vent holes 18 and 54 will be axially aligned with one another. To this end, and as is best shown in FIG. 5, a layer of pressure sensitive adhesive 20 is located at the bottom of the base 5 so as to lie opposite the upstanding prongs 7. A peel-off cover 22 is removably attached to the layer of adhesive 20.

When it is desirable to install the pitch-mark repair tool 1 on putter 50, the peel-off cover 22 is first removed from the adhesive layer 20. The base 5 is now laid flush against and adhesively bonded atop the grip 52 of putter 50 so that the mounting hole 18 through base 5 is aligned with the vent hole 54 through grip 52. With the base 5 bonded to the grip 52 by adhesive layer 20, the fastener 8 is inserted through the slotted mounting hole 18 for receipt at the vent hole 54, whereby the base 50 will now be reliably affixed to the grip 52.

The fastener 8 of pitch-mark repair tool 1 is also preferably manufactured from molded plastic. The fastener 8 has a tapered screw body and helically wound screw threads 24 that run continuously therealong. In order to be able to securely attach the fastener 8 to putter 50 via holes 18 and 54, the helical screw threads 24 slope upwardly relative to the longitudinal axis of the fastener. Moreover, the fasteners terminates at a narrow pointed tip 26 which guides the fastener into the vent hole 54 in grip 52 while minimizing any damage thereto. That is, the pointed tip 26 spreads the vent hole 54 open so as to accommodate the fastener 8 without destroying the vent hole or damaging the grip 52 through which the vent hole is formed. Because of the tapered configuration of fastener 8, the mounting hole 18 through base 5 is wider than the vent hole 54 through grip 52. A head 28 is located opposite the pointed tip 26 of fastener 8 at which to receive a rotational driving force such as that applied by a screw driver or similar tool.

With the base 5 affixed to the grip 52 in the manner just described, the upstanding prongs 7 will project outwardly from the end of the shaft of putter 50. The end cap 3 can now be detachably connected to the base 5 in surrounding engagement therewith so as to cover the prongs 7 and thereby prevent accidental contact with the golfer. Although the end cap 3 is mated to the base 5 by means of a friction fit, a set of dimples 30 (best shown in FIG. 5) are formed at the bottom of end cap 3. A corresponding set of raised protrusions 32 project from the base 5 for receipt within respective ones of the dimples 30 by which a snap-fit interlock is established between cover 3 and base 5.

An access hole 36 is formed through the recess 10 of end cap 3. A rubber grommet 38 is located at the inside of end cap 3 to lie below access hole 36. The access hole 36 is sized to accommodate the existing sharp tip 40 which projects from the underside of the usual golf ball marking disk 14 to hold the disk in place on a putting green. With the marking disk 14 seated in the recess 10 of end cap 3, the tip 40 will extend through the access hole 36 and the grommet 38. The grommet 38 captures the tip 40 extending through access hole 36 whereby marking disk 14 will be removably retained within the recess 10 of end cap 3.

When a golfer wishes to mark the position of his golf ball, he simply uses his fingertips to grasp the ball marking disk 14 at the finger ledges 12 of end cap 3. A pulling force exerted on the marking disk 14 moves the tip 40 thereof out of engagement with the grommet 38 and out of the access hole 36. The marking disk 14 is now unseated from the recess 10 of end cap 3 so as to be conveniently available to the golfer to be pushed into the putting green in the manner illustrated in FIG. 7 of the drawings.

Figure 6:
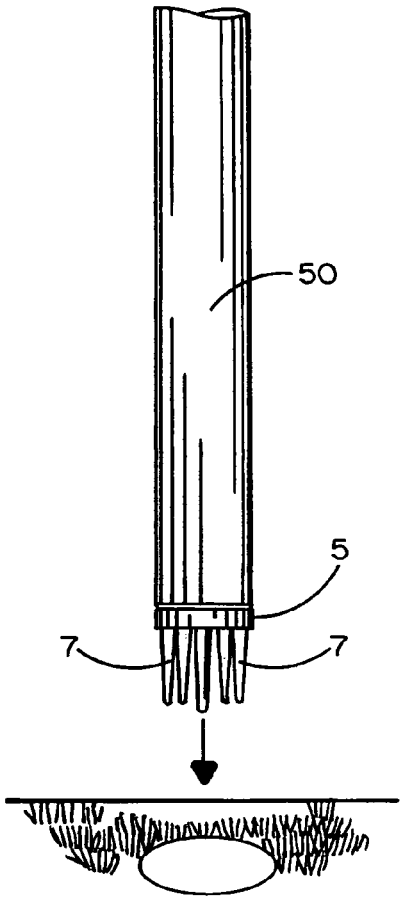
FIG. 6 shows the pitch-mark repair tool at the end of the putter shaft being used to repair a damaged area on a putting green caused by the impact of a golf ball.

When the golfer wishes to repair a pitch-mark area of the putting green caused by the impact of golf ball, he simply grasps the end cap 3. A pulling force exerted on end cap 3 moves the end cap out of engagement with and off the base 5 so as to expose the upstanding earth leveling prongs 7. As is best shown in FIG. 6 of the drawings, the golfer turns his putter 50 upside down and, without having to kneel down, pushes the prongs 7 of base 5 into the area of the putting green in need of repair. By virtue of the slight angle of the upstanding prongs 7, the golfer may comfortably hold the putter 50 away from the vertical. A series of jabbing forces applied to the shaft of putter 50 are transmitted to the prongs 7, whereby to return the green to a level, smooth grass surface in order to support the healing of the ball impact area.

Thus, it may be appreciated that the golfer need only use a single hand to manipulate the prongs 7 of pitch-mark repair tool 1 to facilitate ball mark repair by leveling the impact area with the surrounding grass. As a result of jabbing the grassy surface with the prongs 7, small holes will be formed to establish air channels for promoting a faster healing of the pitch-mark. Once the repair is completed, the end cap 3 is returned to its detachable connection in surrounding engagement with the base 5 as shown in FIGS. 1 and 2 so that the prongs 7 will once again be covered and isolated from contact with the golfer. The golfer can then use his club head to tap down the repaired area to be restored to its original smooth playing surface.

Should he desire, the golfer may separate the pitch-mark repair tool 1 from his putter 50. In this case, the fastener 8 is first removed from vent hole 54 and the base 5 is then pulled off the grip 52. However, there will be little or no damage to the vent hole 54 or grip 52 so that the putter 50 can be used in its normal fashion without having to make repairs thereto.

I claim:

1. A pitch-mark repair tool to be attached to the grip at one end of the shaft of a golf club, said pitch-mark repair tool comprising:

a base to be attached to the grip, said base having a plurality of at least three earth leveling prongs projecting therefrom in parallel alignment with one another and at an angle, not zero, with respect to a longitudinal axis that is perpendicular to said base;

a fastener to extend through said base and said grip for holding said base against said grip;

an end cap detachably connected to said base to enclose said plurality of prongs therewithin, said end cap having a recess that is sized to receive a golf ball marking disk; and a golf ball marking disk seated within said recess and carried by said end cap.

2. The pitch-mark repair tool recited in claim 1, wherein said golf ball marking disk has a sharp tip extending outwardly therefrom to hold said marking disk against a putting green, the recess of said end cap having a hole formed therein to accommodate said sharp tip when said marking disk is seated within said recess.

3. The pitch-mark repair tool recited in claim 1, wherein said end cap has at least one finger ledge lying adjacent said recess for receipt of a golfer's fingertip by which to unseat said golf ball marking disk from said recess for removing said marking disk from said end cap.

4. The pitch-mark repair tool recited in claim 1, wherein said base also has a layer of adhesive and a peel-off cover lying over said layer of adhesive, said base being adhesively bonded to the grip at the one end of the golf club shaft by means of said layer of adhesive after said peel-off cover has first been removed therefrom.

5. The pitch-mark repair tool recited in claim 1, wherein said base has at least one protrusion and said end cap has at least one dimple, said protrusion being snap-fit within said dimple by which said end cap is detachably connected to said base.

6. The pitch-mark repair tool recited in claim 1, wherein said fastener has a set of helically wound screw threads running continuously therealong.

7. The pitch-mark repair tool recited in claim 1, wherein said fastener includes a head located at one end thereof at which to receive a rotational driving force and a pointed tip located at the opposite end to be received through said base and said grip for holding said base against said grip.

8. The pitch-mark repair tool recited in claim 1, wherein said plurality of earth leveling prongs project from said base in parallel alignment with one another and at an angle relative to the perpendicular axis of said base.

9. In combination:

a golf club including a shaft having a hollow interior, a ball striking head located at one end of the shaft, a grip surrounding the opposite end of the shaft, and a vent hole formed through the grip of said shaft to communicate with hollow interior thereof; and a pitch-mark repair tool to be attached to the grip at the opposite end of said shaft without having to alter said grip, said pitch-mark repair tool comprising:

a base located against said grip, said base having a plurality of at least three earth leveling prongs projecting therefrom in parallel alignment with one another at an angle, not zero, with respect to a longitudinal axis that is perpendicular to said base;

a screw extending through each of said base, said grip, and a said vent hole, said screw having a set of screw threads running continuously therealong by which to hold said base against said grip; and an end cap detachably connected to said base to enclose said plurality of prongs therewithin.

10. The combination recited in claim 9, further comprising a golf ball marking disk, said end cap having a recess formed therein, and said marking disk seated within said recess so as to be carried by said end cap.

11. The combination recited in claim 9, wherein said screw has a pointed tip and a tapered body with said set of screw threads running therealong by which to enable said screw to penetrate said base, said grip, and said vent hole and to hold said base against said grip.

* * * * *